US005860538A

United States Patent [19]

Duero et al.

[11] Patent Number: 5,860,538

[45] Date of Patent: Jan. 19, 1999

[54] ACCESSORY ATTACHMENT SYSTEM

[75] Inventors: Steven J. Duero, Waubeka, Wis.; Roger W. Murphy, Kohler, Wis.

[73] Assignee: Kohler Co., Kohler, Wis.

[21] Appl. No.: 784,462

[22] Filed: Jan. 16, 1997

[51] Int. Cl.[6] ..... A47H 1/00; A47B 95/00

[52] U.S. Cl. ..... 211/123; 211/105.1; 248/201; 248/251; 16/111 R; 16/DIG. 5; 16/DIG. 24

[58] Field of Search ..... 211/123, 105.1; 248/201, 251; 16/111 R, DIG. 5, DIG. 24; 4/567, 601, 615

[56] References Cited

U.S. PATENT DOCUMENTS

| | | | |
|---|---|---|---|
| 1,055,098 | 3/1913 | Stone | 248/251 |
| 1,115,492 | 11/1914 | Bond . | |
| 1,267,197 | 5/1918 | Euler | 211/123 |
| 1,800,030 | 4/1931 | Reynolds | 248/251 |
| 2,196,571 | 4/1940 | Van Gorden | 287/119 |
| 2,766,892 | 10/1956 | Graber | 211/96 |
| 4,349,940 | 9/1982 | Fleischmann et al. | 16/110 |
| 4,523,734 | 6/1985 | Grohe | 248/251 |
| 4,998,321 | 3/1991 | Gaffney et al. | 16/10 |
| 5,050,250 | 9/1991 | Cuttriss | 248/201 |
| 5,385,248 | 1/1995 | Klein, Jr. | 16/111 R |

FOREIGN PATENT DOCUMENTS

| | | | |
|---|---|---|---|
| 0137179 | 3/1949 | Australia | 211/123 |
| 1004300 | 9/1965 | United Kingdom | 16/111 R |

*Primary Examiner*—Victor N. Sakran
*Attorney, Agent, or Firm*—Quarles & Brady

[57] ABSTRACT

A system for attaching an accessory to a support housing which affords ease of fastening and a hidden fastening system. The system includes a locking stem having a head connected to a body by a neck. The accessory engages the support housing at an angle. The head of the locking stem is positioned in the accessory and the body positioned in the support housing. Movement of body away from the accessory causes the head to engage opposing inside surfaces of the accessory and effect a locking of the accessory to the support housing and a frame. In a preferred embodiment, the accessory is a towel bar and the support housing is connected to a shower door frame.

9 Claims, 5 Drawing Sheets

FIG. 6A
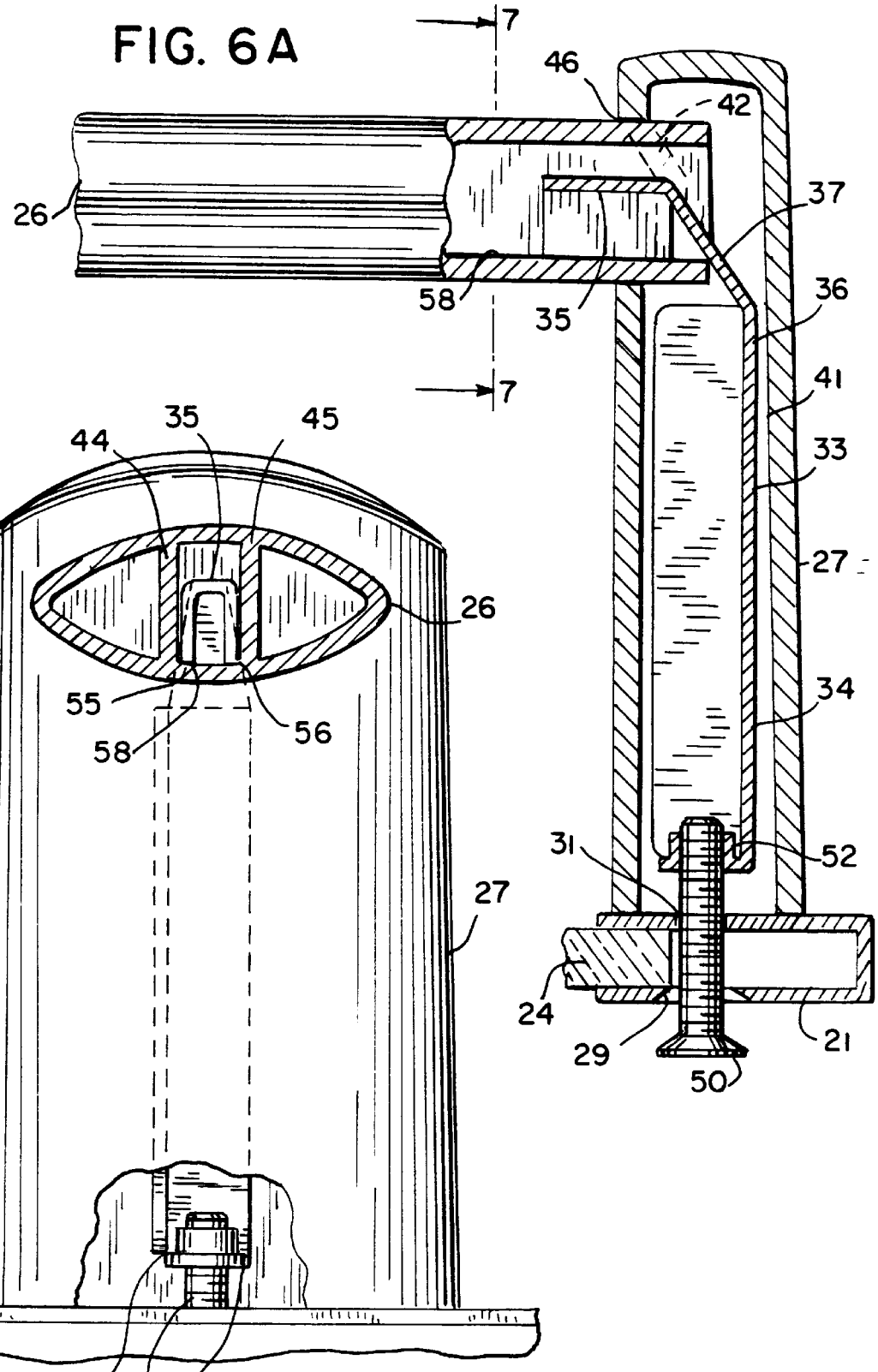
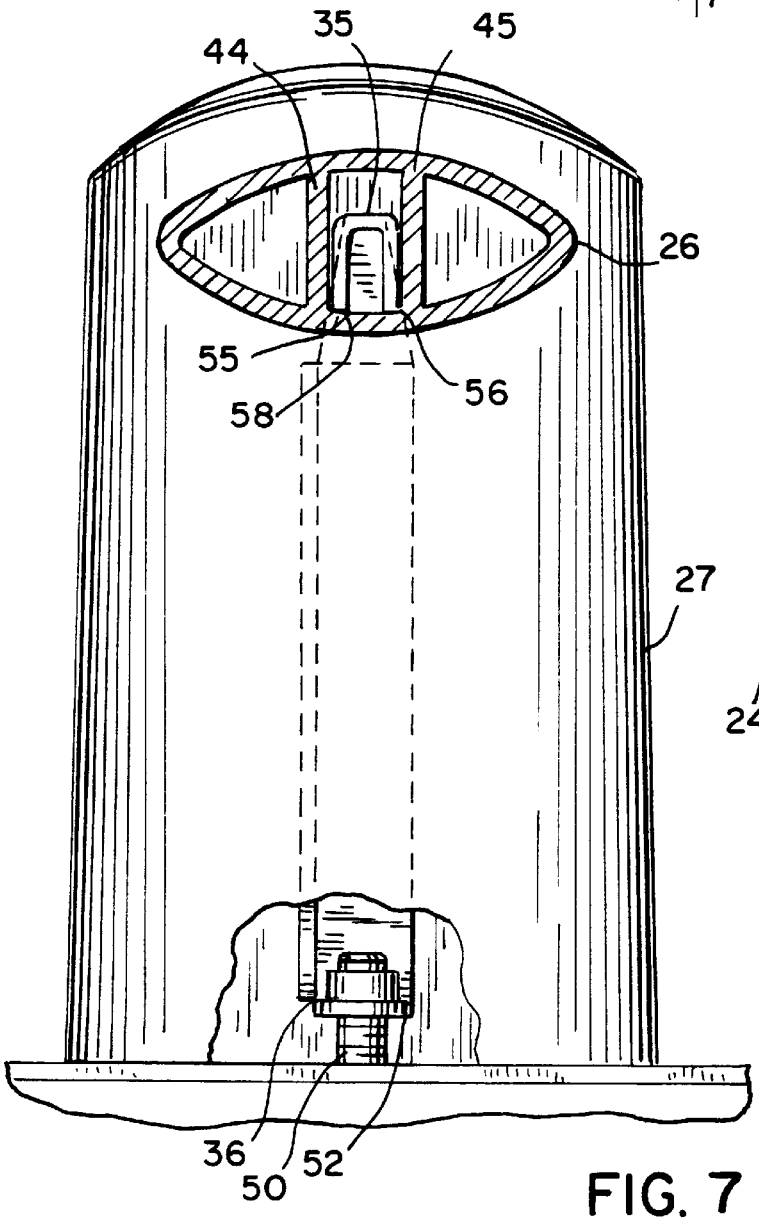
FIG. 7

FIG. 6B
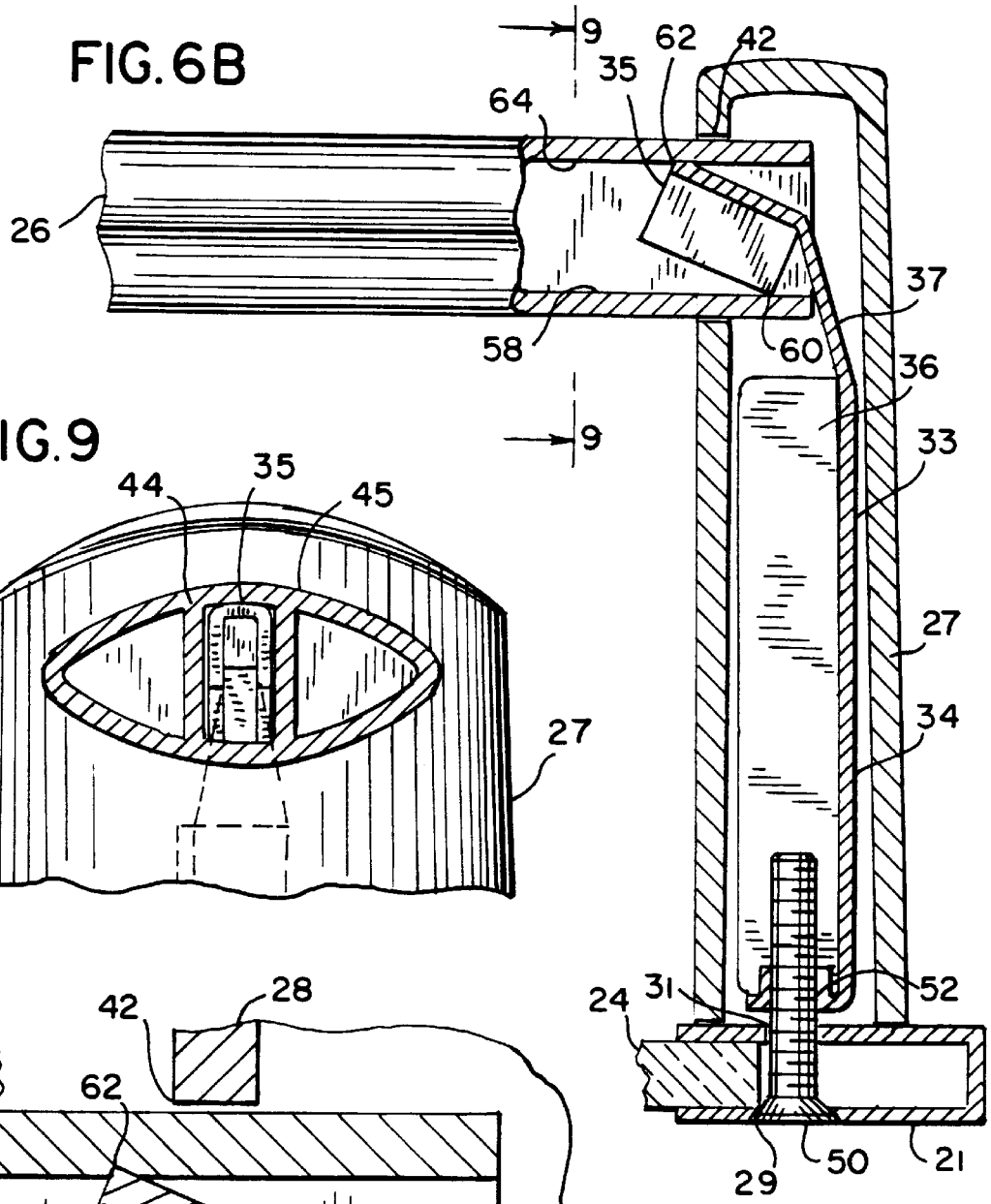
FIG. 9
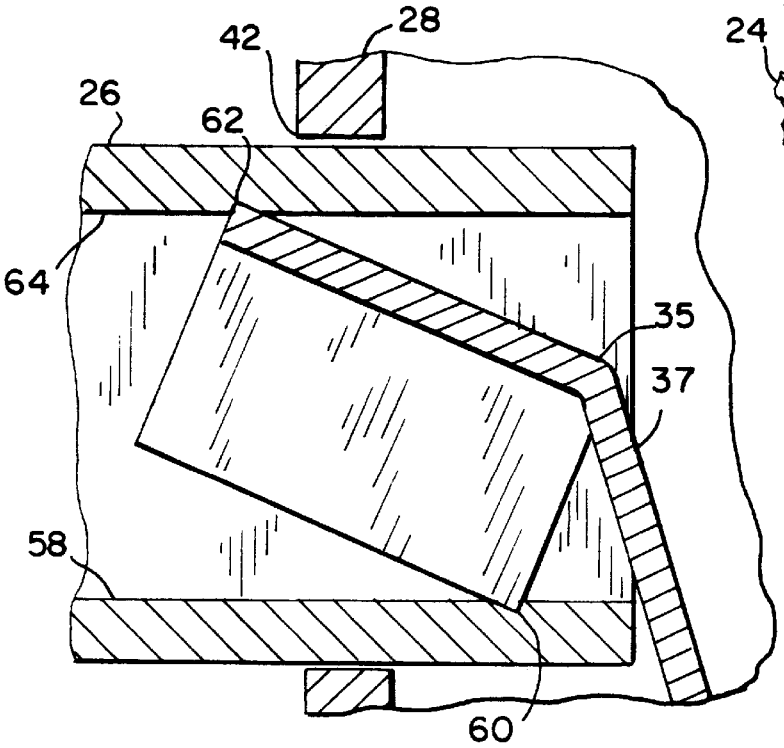
FIG. 8

ACCESSORY ATTACHMENT SYSTEM

BACKGROUND OF THE INVENTION

This invention relates to a system for connecting components of a plumbing fixture, wherein a support member can be easily and quickly fastened to a support housing. More particularly, the invention relates to an attachment system for connecting a towel bar to a shower door frame.

In U.S. Pat. No. 1,115,492 there is disclosed an attachment system for a support member wherein the attachment is hidden from view. While this system is simple in its design, a more stable connection is required where heavy loads are to be supported.

Thus a need exists for an attachment system which is not only hidden from view for aesthetic reasons but also provides a more rigid connection.

BRIEF SUMMARY OF THE INVENTION

In one embodiment, the invention provides an accessory attachment system for attaching an accessory to a support wall. A tubular housing has an axial inlet, a radial inlet and an interior cavity connecting the inlets. A locking stem is connectable to the support wall and extendable through the tubular housing, the cavity and inlets. An accessory has a cavity for receiving an end of the stem adjacent the radial inlet. Axial movement of the stem in the tubular housing toward the support wall can, via a bending of a portion of the stem, drive the stem into locking engagement with the accessory.

In one aspect, the accessory is a bar.

In a preferred embodiment, the accessory is a towel bar and the support wall is part of a shower enclosure door.

In another preferred embodiment the towel bar is aluminum and at least part of the stem is steel so that during bending the stem deforms the accessory to embed itself thereon.

In yet another preferred embodiment, there are guide ribs positioned in the tubular housing to guide the stem during bending and a wing member extends from the stem for contact with an inside wall surface of the housing.

In a preferred form, the stem is connected to a support wall by a threaded member constructed and arranged such that rotation of the threaded member in one direction causes the stem to move toward the support wall with resulting pivoting of the stem in the accessory.

The objects of the invention therefore include:

a. providing a system of the above kind which affords ease of fastening and removal without exposed screws;

b. providing a system of the above kind which is aesthetically attractive;

c. providing a system of the above kind which affords a sturdy connection; and d. providing a system of the above kind which can be employed without the need of tools other than a conventional screwdriver.

These and still other objects and advantages of the invention will be apparent from the description which follows. In the detailed description below, a preferred embodiment of the invention will be described with reference to the accompanying drawings. The embodiment does not represent the full scope of the invention. Rather the invention may be employed in other embodiments. Thus, the claims should be looked to in order to judge the scope of the invention.

BRIEF DESCRIPTION OF THE DRAWINGS

FIG. 6A is plan view, partially in section showing an assembled view of the fixture attachment system;

FIG. 6B is a view similar to FIG. 6A showing the attachment system in a further stage of assembly;

FIG. 7 is an enlarged sectional view taken along line 7—7 of FIG. 6A (and partially fragmented);

FIG. 8 is an enlarged partial view of FIG. 6B; and

FIG. 9 is a sectional view taken along line 9—9 of FIG. 6B.

DETAILED DESCRIPTION

Figure 1:
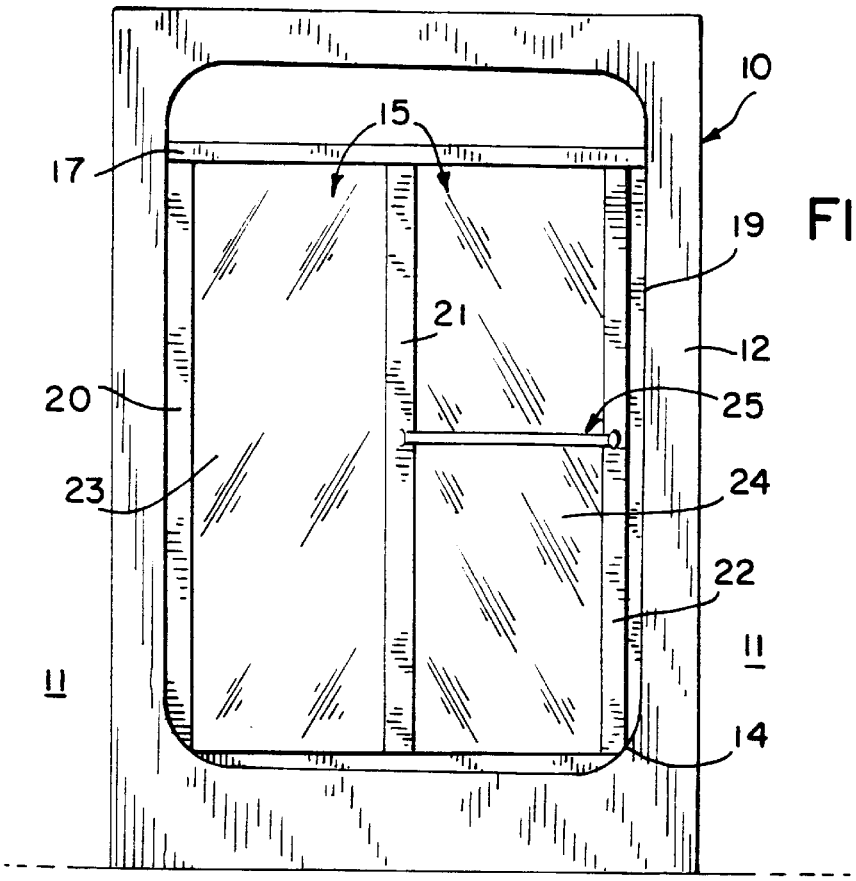
FIG. 1 is a front elevational view of a shower enclosure which incorporates the present invention.

Referring to FIG. 1 there is shown a shower enclosure, generally 10, which is located between bathroom walls 11. The shower enclosure includes a front wall portion 12 providing a framed entranceway 14 to the enclosure 10.

The entranceway 14 is closed by slidable doors, generally 15. There is a header 17 and side door jambs 19 and 20. Glass doors 23 and 24 are suspended from the header 17 using the usual track roller system. A towel bar/handle assembly, generally 25, is connected to frames 21 and 22 of door 24.

Figure 2:
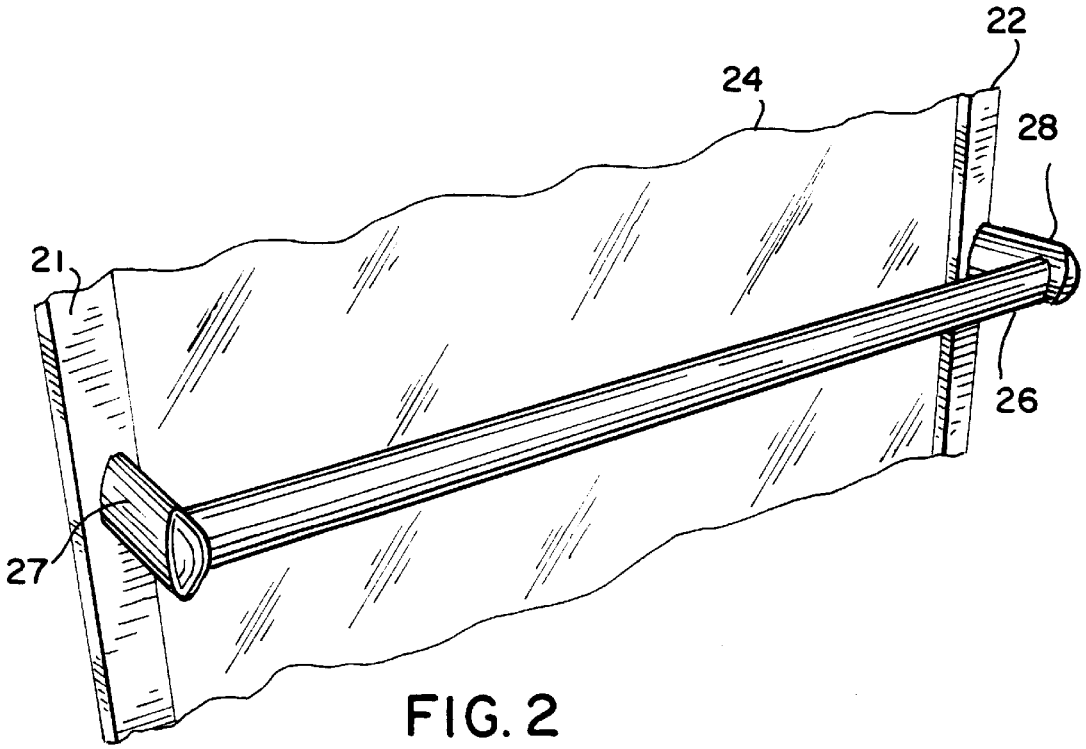
FIG. 2 is an enlarged perspective view of the handle/towel bar portion thereof shown mounted on the FIG. 1 shower door.
Figure 3:
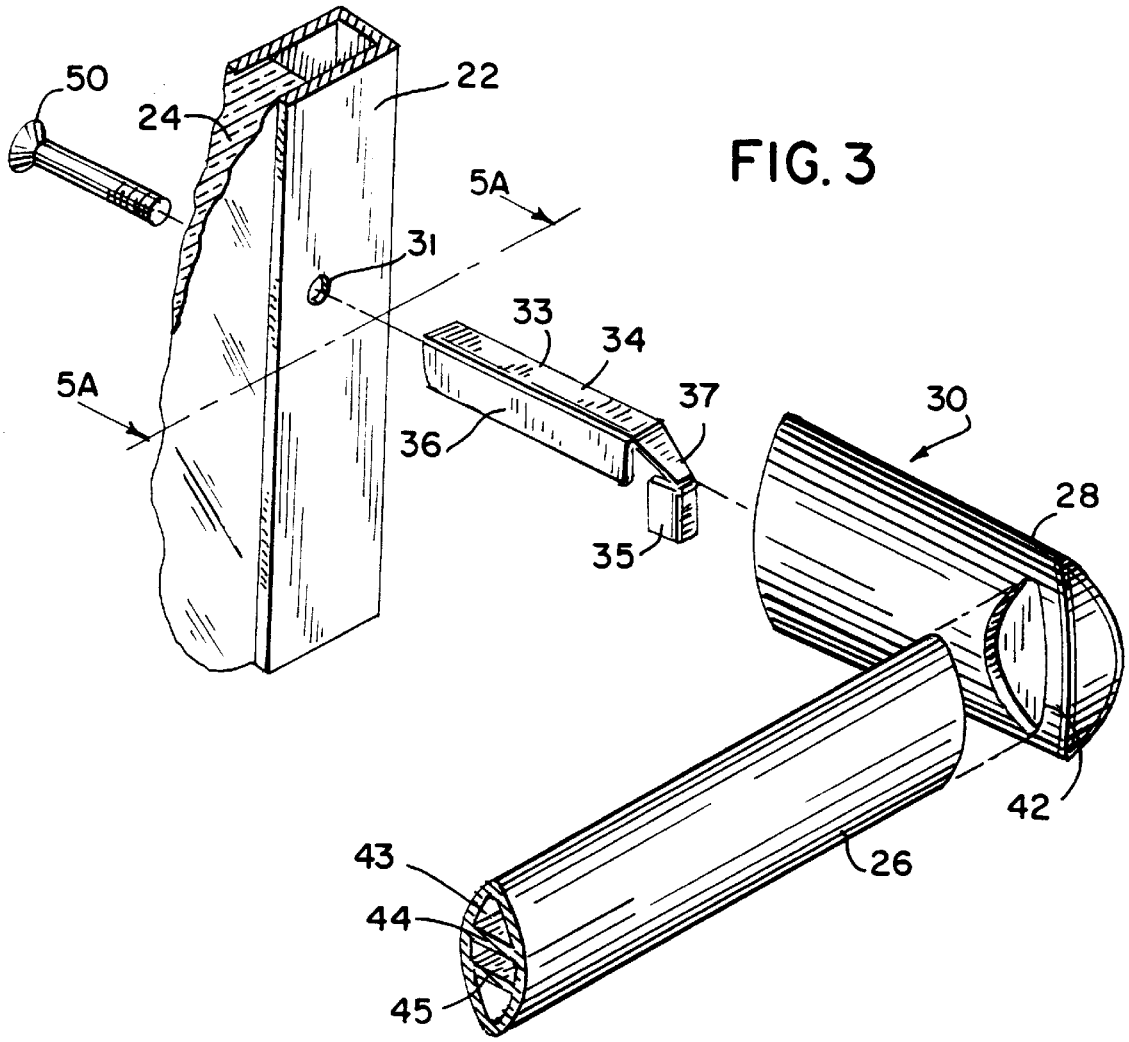
FIG. 3 is an exploded view of certain of the component parts of the FIG. 2 assembly.
Figure 4:
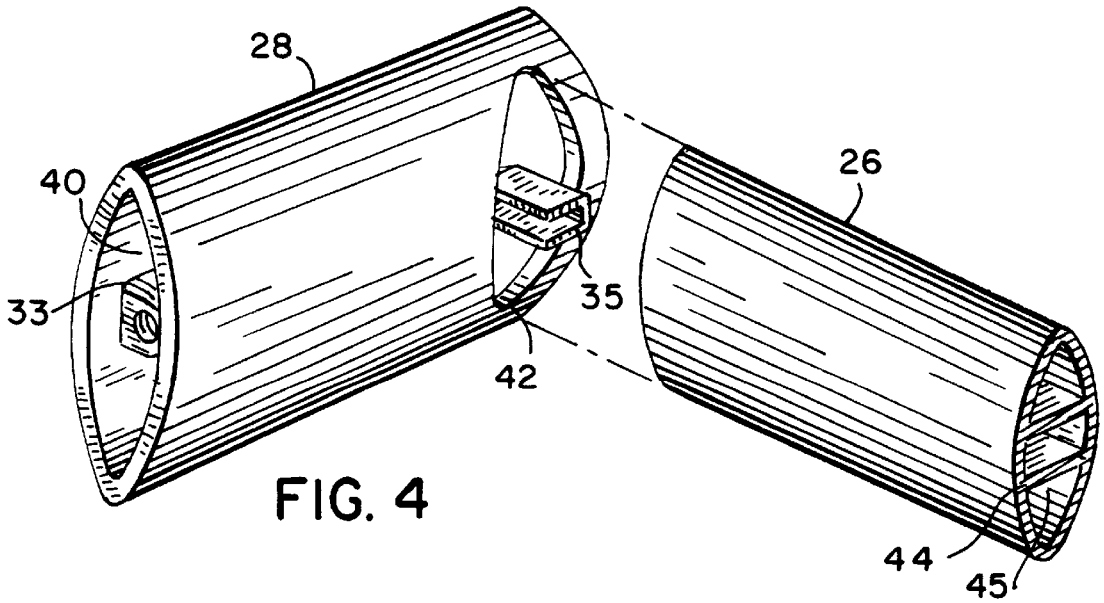
FIG. 4 is an exploded view of several of the component parts shown in FIG. 3, albeit from a different view.

With particular reference to FIGS. 2, 3 and 4, an attachment system, generally 30, is employed to attach bar 26 and support housings 27 and 28 to the door 24. The attachment system 30 includes a locking mechanism 33 having a body 34, a head 35 which is U-shaped in cross section, and a neck 37, all of which are preferably composed of stainless steel.

As seen in FIGS. 2, 3, 4 and 6A, locking mechanisms 33 are received in cavity portions 40 and 41 of support housings 28 and 27, respectively. Initially, locking mechanism 33 is loosely connected to panel frame 22 by the screw 50. The longitudinal axis of the body 34 is aligned with the longitudinal axis of the support housing 28 with the head 35 aligned with the largest transverse axis of the oval cavity portion 40. The locking mechanism 33 is then inserted into support housing 28 to a position where head 35 is opposite lateral or radial inlet opening 42 of the support housing 28. At this position, the locking mechanism 33 is rotated 90° so that head 35 extends through opening 42 (see FIG. 4). At this stage, a section of bar 26 is fitted into the opening 42 with the head 35 positioned between the ribs 44 and 45 in a passage 43 of the bar 26.

Figure 5A:
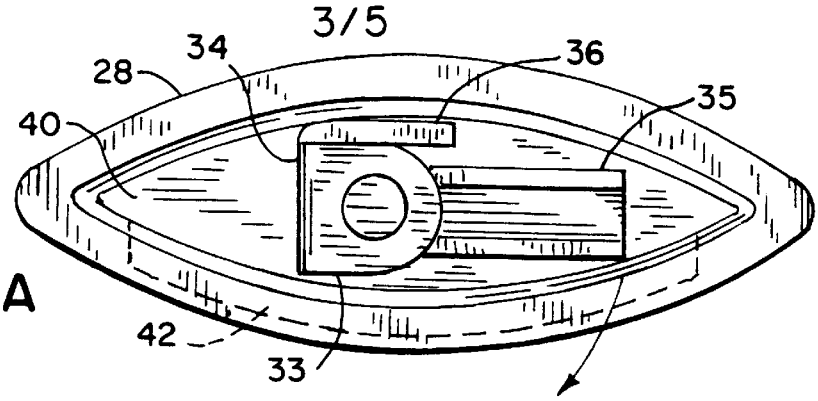
FIG. 5A is a sectional view taken along line 5A—5A of FIG. 3 (if parts 28 and 33 were positioned on door panel frame 22)
Figure 5B:
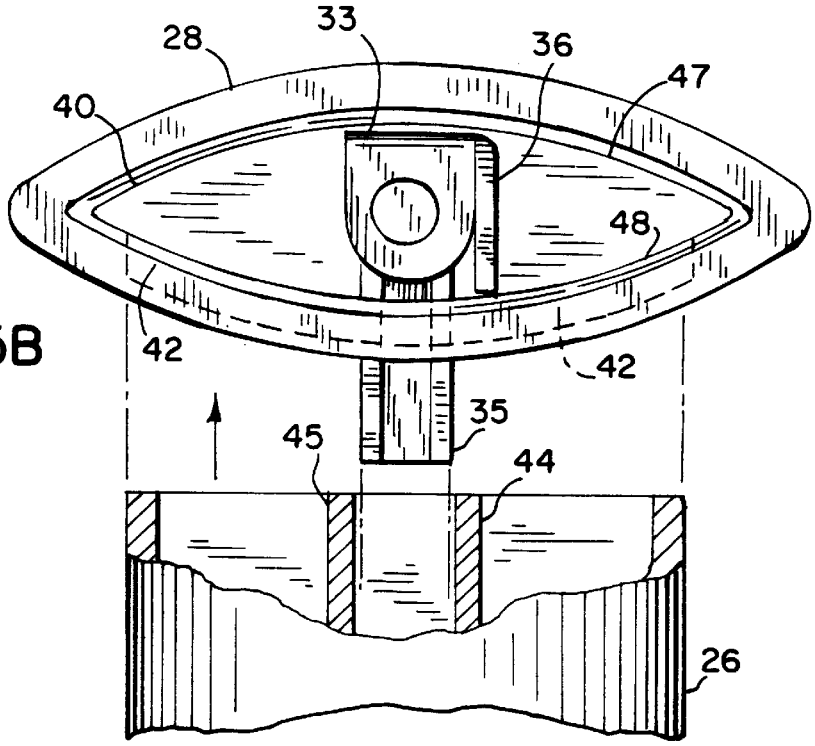
FIGS. 5B and 5C are views similar to FIG. 5A illustrating further steps of connection of the component parts.
Figure 5C:
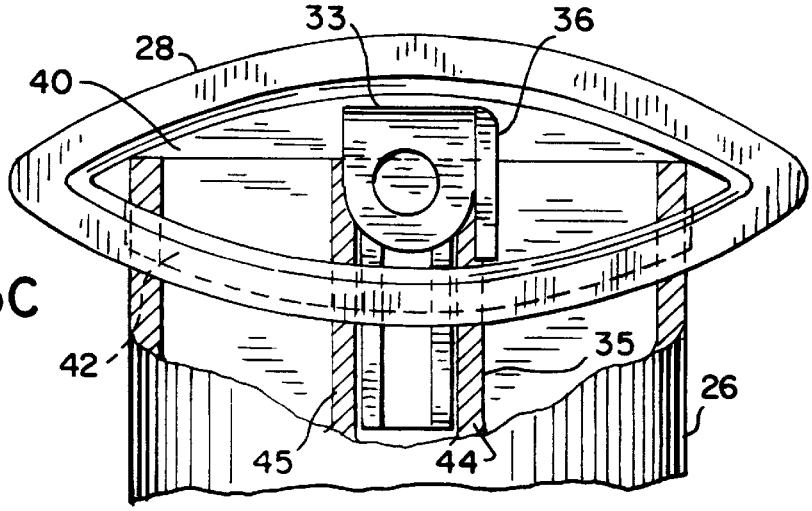

FIGS. 5A, 5B and 5C illustrate the previously described orientation and turning of the locking mechanism 33 inside the support housing 28, as well as the fitting of the head 35 between the ribs 44 and 45 of bar 26. FIG. 5A shows the locking mechanism 33 as it is initially placed in the cavity 40 of support housing 28, and FIG. 5B illustrates the alignment of the locking mechanism 33 with the bar 26 as indicated in FIG. 4. FIG. 5C shows the bar 26 seated in the support housing 28 with the head 35 of locking mechanism 33 positioned between the ribs 44 and 45 of bar 26.

FIGS. 6A, 6B, and 7–9 focus on the locking feature of the locking mechanism 33 (compare especially FIGS. 6A and 6B). Head 35 is positioned through opening 46 of housing 27 and into bar 26 such that the ends of side walls 55 and 56 (FIG. 7) of head 35 rest on the inside wall surface 58. In the position shown in FIG. 6A, the longitudinal axis of the head 35 is parallel with the longitudinal axis of bar 26.

To lock the locking mechanism 33 to the bar 26, screw 50 is turned in nut 52 connected to body 34 so that body 34 is moved inside cavity 41 of the support housing 27 toward panel frame 21. Holes 29 and 31 in the door 24 afford the screw connection through panel frame 21. Turning of screw 50 and movement of body 34 causes head 35 to pivot as it is pulled downwardly by the neck 37. This pivoting is effected by the rear corner portions such as 60 of the head 35 embedding into inside wall surface 58 of bar 26. At the same time, upper front corner portion 62 of the head 35 embeds into the opposing inside wall surface 64 of bar 26. This embedding of the head 35 into the bar 26 and the deformation of the bar is assisted by the fact that the head 35 is preferably made of stainless steel, and the bar is preferably composed of aluminum.

Referring back to FIG. 2, there are two such support housings 27 and 28. The same previously described procedure is followed with respect to support housing 28 to fasten bar 26 to panel frame 22.

In order to disconnect the bar 26 and attachment system 30, screw 50 is turned so as to remove it from locking mechanism 33. A screwdriver is then used to push the threaded end of the locking mechanism 33 with nut 52 inwardly until tension on the locking mechanism 33 is relieved. This causes disengagement of the head 35 with the inside wall surfaces 58 and 64 of the bar 26. The component parts can then be disassembled.

An important feature of the assembly 25 is the design of the neck and head 37 and 35, respectively, which affords the previously described pivoting of the head 35 as the body 34 is moved away from the bar 26. Still another important feature is the wing 36 extending from the body 34 of locking mechanism 33. This is seen in FIGS. 5A–5C and prevents the body member 34 from twisting as torque is applied by the screw 50. The body 34 would otherwise tend to twist independent of the head 35. It should be noted that twist tends to occur in the weakest region which is the link or neck member 37. As seen in FIG. 5B, the wing 36 contacts the wall 48 of the support housing preventing the body 34 of the locking mechanism 33 from turning. In addition, the wing 36 prevents the head 35 from moving back and forth between walls 47 and 48 within the support housing 28 so that the bar 26 does not move back and forth within the support housings 27 and 28.

It will thus be seen that there is now provided an attachment system for a bar (or the like) assembly which is easy to assemble and disassemble. The assembly affords a hidden, watertight connection (with no exposed screws), yet allows ease of operation.

While a preferred embodiment has been described above, it should be apparent from this disclosure to those skilled in the art that a number of modifications may be made without departing from the spirit and scope of the invention. For example, in the previous description, there is shown a bar 26 for connection with support housings 27 and 28. If desired, the assembly could be utilized in conjunction with any angled, hollow structure which provides a contacting surface for frictional engagement with the head 35 of locking mechanism 33. Further, while head 35 is depicted as U-shaped in configuration, other configurations could be used such as a T-shape with a single leg. In addition, whereas the locking mechanism 33 is described for use in conjunction with door frames 21 and 22, it could be used with other frame structures. Thus, the claims should be looked to in order to judge the full scope of the invention.

We claim:

1. An accessory attachment system for attaching an accessory to a support wall, comprising:

a tubular housing having an axial inlet, a radial inlet and an interior cavity connecting the inlets;

a locking stem connectable to the support wall and extendable through said tubular housing, said cavity and said inlets; and an accessory having a cavity for receiving an end of the stem adjacent the radial inlet;

whereby axial movement of the stem in the tubular housing toward the support wall can, via a bending of a portion of the stem, drive the stem into locking engagement with the accessory.

2. The system of claim 1, wherein the accessory is a bar.

3. The system of claim 2, wherein the bar is aluminum and at least part of the stem is steel.

4. The system of claim 1, wherein the accessory is a towel bar and the support wall is part of a shower enclosure door.

5. The system of claim 1, wherein during the bending, the stem deforms the accessory to embed itself therein.

6. The system of claim 1, further including guide ribs positioned in the accessory to guide the stem member during bending.

7. The system of claim 1, wherein when the stem is connected to the support wall by a threaded member, the threaded connection can be constructed and arranged such that rotation of the threaded member in one direction causes the stem to move toward the support wall with a resulting pivoting of the stem in the accessory.

8. The system of claim 1, wherein the stem is U-shaped in cross-section adjacent the accessory.

9. The system of claim 1, wherein a wing member extends from the stem for contact with an inside wall surface of the tubular housing.

* * * * *